United States Patent [19]

Ball, Jr. et al.

[11] 4,131,657

[45] Dec. 26, 1978

[54] ELECTRIC AUTOMOTIVE CHOKE

[75] Inventors: George A. Ball, Jr., Cape Elizabeth; George H. Simpson, Westbrook, both of Me.

[73] Assignee: GTE Sylvania Incorporated, Danvers, Mass.

[21] Appl. No.: 776,396

[22] Filed: Mar. 10, 1977

[51] Int. Cl.[2] ..... F02M 1/12

[52] U.S. Cl. ..... 261/39 E; 123/119 F; 337/100; 337/378; 338/22 R

[58] Field of Search ..... 261/39 E; 123/119 F; 337/378; 338/22 R

[56] References Cited

U.S. PATENT DOCUMENTS

| | | | |
|---|---|---|---|
| 1,656,706 | 1/1928 | Hann | 337/378 |
| 2,309,170 | 1/1943 | De Beaumont | 261/39 E |
| 3,752,133 | 8/1973 | Irish et al. | 261/39 E |
| 3,800,767 | 4/1974 | Winkley | 261/39 E |
| 3,806,854 | 4/1974 | Armstrong | 261/39 E |
| 3,898,967 | 8/1975 | Bennett et al. | 261/39 E |
| 4,031,499 | 6/1977 | Brueckner | 338/22 R |
| 4,038,955 | 8/1977 | Paulmier | 261/39 E |

*Primary Examiner*—Tim R. Miles
*Attorney, Agent, or Firm*—James Theodosopoulos

[57] ABSTRACT

An electric choke assembly includes a heater to heat a coiled bimetallic spring which opens a choke valve. The heater comprises a double ring electroded thermistor for the purpose of generating two different heating rates which are controlled by a bimetallic thermostat blade located in the same chamber of the assembly as the thermistor.

9 Claims, 5 Drawing Figures

ELECTRIC AUTOMOTIVE CHOKE

THE INVENTION

This invention concerns an automatic choke assembly for use with carburetors of internal combustion engines. Such a choke is shown in U.S. Pat. No. 3,898,967 the disclosure of which is incorporated herein by reference.

An automatic choke in accordance with this invention provides rapid opening of the choke valve but contains fewer parts and is simpler to manufacture than similar prior art chokes.

In the drawing, FIG. 1 is a view of part of an electric choke assembly in accordance with this invention.

Figure 2:
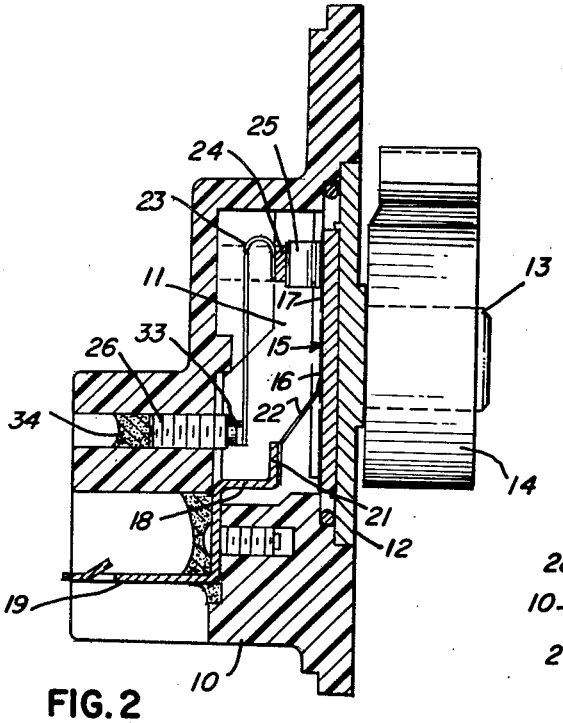
FIG. 2 is a sectional view of the assembly.
Figure 1:
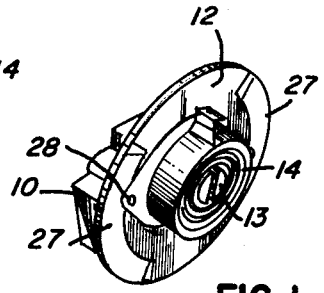
Figure 3:
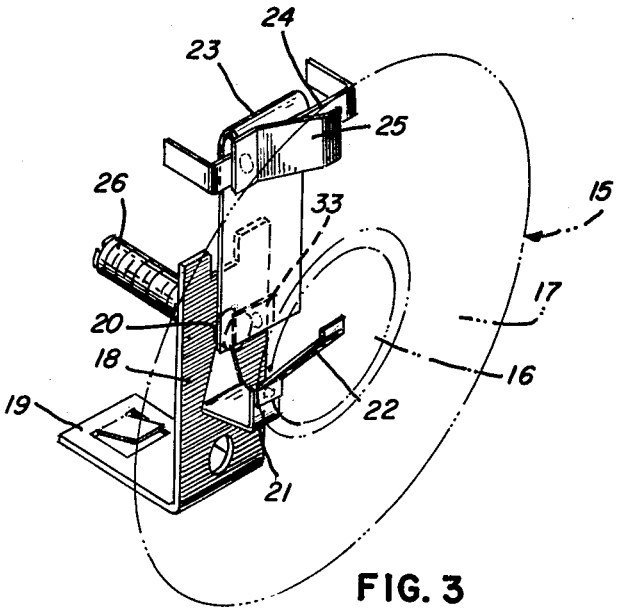
FIG. 3 is a detail view of the thermostat portion of the assembly showing the thermistor in phantom.

The choke assembly shown in FIGS. 1, 2 and 3 comprises a housing 10 having a chamber 11 therein. Closing off chamber 11 is a generally circular thermally conductive coil mounting plate 12 from which protrudes a thermally conductive slotted post 13 on which is mounted the usual coiled bimetallic spring 14 which is connected (not shown) to the usual choke valve. A thermistor disc 15 is surface bonded, in an electrically conductive and thermally conductive manner, for example, soldered, to the chamber side of plate 12. The opposite surface of disc 15 is double ring electroded, that is to say, there is a small area circular electrode 16 at the center of said surface surrounded by a larger area outer electrode 17 which is spaced therefrom.

Extending into chamber 11 is an L shaped conductive member 18 which comprises an external terminal 19 and, within chamber 11, a leg 21. There is also a slot 20 in a portion of member 18 within chamber 11. A contact spring 22 is electrically connected to leg 21 and is in electrical contact with center electrode 16 of thermistor disc 15.

Disposed within chamber 11 is a cantilever bimetal thermostat blade 23 having a U shaped end fastened to a U shaped support 24. A contact spring 25 is electrically connected to support 24 and is in electrical contact with outer electrode 17 of thermistor disc 15. The other end of blade 23 is unattached but, at a predetermined temperature, makes electrical contact with the palladium-tipped end of a set screw 26 which is threaded through slot 20 of conductive member 18, thereby establishing an electrical path between outer electrode 17 and terminal 19 when thermostat blade 23 is in contact with set screw 26.

Coil mounting plate 12 is electrically connected to ground plates 27 by rivets 28 therethrough. Ground plates 27 place coil mounting plate 12 at the ground potential of the carburetor on which the choke assembly is mounted, while terminal 19 is connected to the positive voltage side of the automobile electrical system.

In operation, when the automobile is started with a cold engine and the ambient is less than, say, 50° F., thermostat blade 23 is open and current flow through thermistor disc 15 occurs only at center ring electrode 16, the nominal resistance of which is about ten ohms. The current, thus, is about one to one and a half amperes, and thermistor disc 15 develops a relatively small amount of heat. Gradually, however, this heat is enough to close thermostat blade 23 which completes the circuit through outer ring electrode 17 with the result that current flows through the entire disc 15, the nominal resistance of which is about 2½ ohms. This higher current now results in a faster heating rate of coiled spring 14 and, thus, faster opening of the choke valve than if electrode 17 were not in the circuit.

If the engine is warm at the time of starting, or the ambient is above, say, 70° F., thermostat blade 23 is closed and the entire disc 15 is conductive. Consequently, the choke valve will open faster than in the previous case.

The current flow through disc 15 eventually heats it to its anomaly temperature, say, about 170° C., at which point the resistance increases markedly by several orders of magnitude and the current flow is correspondingly reduced to about 300 milliamperes. This is the steady state operation for thermistor disc 15 and is maintained until the engine is shut off.

The thermostat is calibrated, prior to installation of the choke, by submersing the assembly in an inert liquid maintained at the required calibration temperature. When the temperature of thermostate blade 23 has stabilized, calibrating screw 26 is slowly advanced until contact with blade 23 is just made; screw 26 can then be fixed in this position with a suitable adhesive 34.

Figure 4:
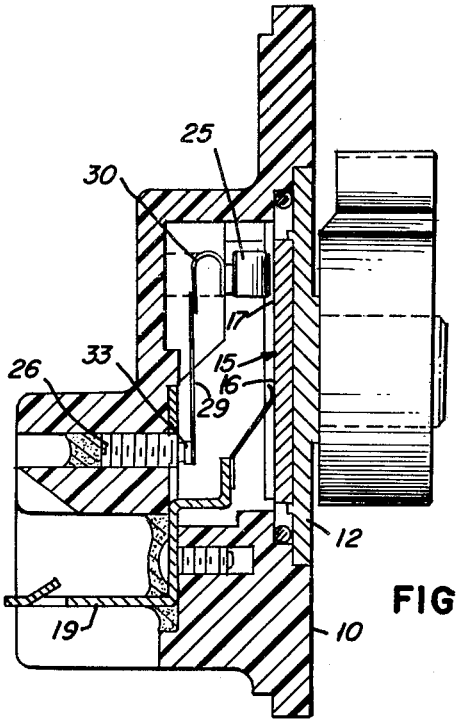
FIGS. 4 and 5 show other embodiments of the invention.

In another embodiment, shown in FIG. 4, cantilever bimetal blade 23 is replaced by a snap acting bimetal blade 29. However, since the snap temperature of such a blade can gradually change because of the stresses in blade 29 resulting from its constant pressure against calibration screw 26 at normal engine temperatures, blade 29 is mounted on a U shaped cantilever bimetal 30. Bimetal 30 is mounted so as to move in the opposite direction from blade 29 as the temperature increases, thereby relieving some of the pressure and preventing overstressing of blade 29.

Figure 5:
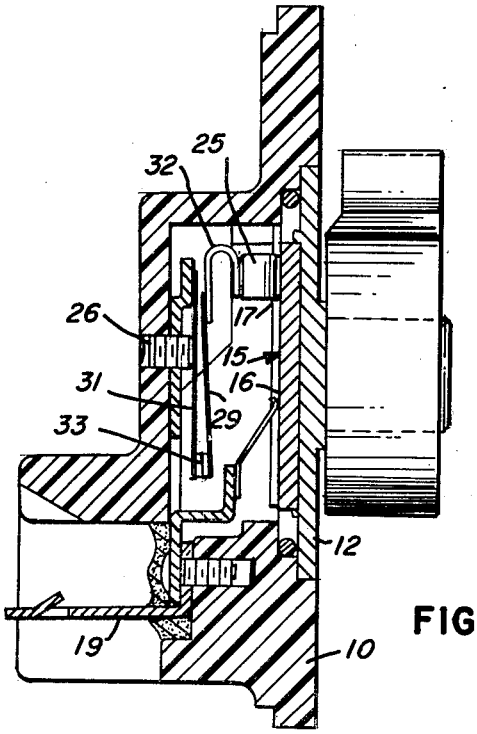

In another embodiment, shown in FIG. 5, overstressing of snap acting blade 29 is prevented by having blade 29 make contact, when closed, with a spring member 31 which is in contact with screw 26. Spring member 31 gives or yields with the force applied by blade 29 to prevent overstressing. In this embodiment U shaped member 32 need not be bimetallic.

As is known, the usual noble metal tips 33 may be placed at the contact points of the various bimetal or spring members.

We claim:

1. An electric choke assembly for the carburetor of an automotive internal combustion engine comprising a housing having a chamber therein a thermistor disc and a thermostat blade disposed in said chamber so that the thermostat blade is proximate the thermistor disc and in heat-transfer relationship therewith, the thermostat blade being open below a predetermined temperature range and closed above said temperature range, the thermistor disc generating heat at one rate when the thermostat blade is open and at a greater rate when the thermostat blade is closed, and means to electrically energize the assembly.

2. The assembly of claim 1 wherein said thermistor disc is double ring electroded on the surface that is proximate the thermostat blade.

3. The assembly of claim 1 comprising, in addition, means for calibrating the closing temperature of the thermostat blade.

4. The assembly of claim 2 comprising, in addition, a conductive member extending through said housing and having an external terminal and an internal leg, the internal leg being electrically connected to one of the double ring electrodes of the thermistor disc.

5. The assembly of claim 4 wherein the thermostat blade is electrically connected between an internal portion of said conductive member and the other one of the double ring electrodes of the thermistor disc.

6. The assembly of claim 5 comprising, in addition, a calibrating screw extending through said housing and threaded into a slot in said internal portion of said conductive member, the thermostat blade being in contact with the tip of the calibrating screw at a temperature above said predetermined temperature range and spaced therefrom below said range.

7. The assembly of claim 1 wherein said thermostat blade is snap acting or cantilever type.

8. The assembly of claim 7 wherein said thermostat blade is snap acting and is connected to a stress-relieving bimetallic member.

9. The assembly of claim 7 wherein said thermostat blade is snap acting and is in contact, when closed, with a stress-relieving spring member.

* * * * *